United States Patent [19]

Morris et al.

[11] Patent Number: 5,003,214

[45] Date of Patent: Mar. 26, 1991

[54] METAL HALIDE LAMP HAVING REFLECTIVE COATING ON THE ARC TUBE

[75] Inventors: James Morris, Wakefield; Zeya K. Krasko, Danvers; William M. Keeffe, Rockport, all of Mass.

[73] Assignee: GTE Products Corporation, Danvers, Mass.

[21] Appl. No.: 574,567

[22] Filed: Aug. 24, 1990

Related U.S. Application Data

[63] Continuation of Ser. No. 944,646, Dec. 19, 1986, abandoned.

[51] Int. Cl.[5] ..... H01J 17/16; H01J 61/35

[52] U.S. Cl. ..... 313/25; 313/112

[58] Field of Search ..... 313/112, 113, 25, 635, 313/634, 44

[56] References Cited

U.S. PATENT DOCUMENTS

| | | | |
|---|---|---|---|
| 3,226,597 | 12/1985 | Green . | |
| 3,325,662 | 6/1967 | Cook . | |
| 3,851,200 | 11/1974 | Thomasson | 313/113 |
| 3,889,142 | 6/1975 | Keeffe | 313/44 |
| 3,931,536 | 1/1976 | Fohl et al. | 313/113 |
| 3,959,524 | 5/1976 | Keeffe | 427/106 |
| 3,963,951 | 6/1976 | Ramberg | 313/44 |
| 3,988,628 | 10/1976 | Clausen | 313/112 |
| 4,012,655 | 3/1987 | McVey et al. | 313/27 |
| 4,047,067 | 9/1977 | Clausen | 313/635 |
| 4,091,163 | 5/1978 | Clausen | 428/336 |
| 4,225,635 | 9/1980 | Yoldas | 427/106 |
| 4,249,102 | 2/1981 | Krieg et al. | 313/116 |
| 4,467,238 | 8/1984 | Silverstein et al. | 313/635 X |
| 4,620,125 | 10/1986 | Keeffe et al. | 313/25 |
| 4,629,929 | 12/1986 | Saito et al. | 313/25 |
| 4,678,960 | 7/1987 | Reiling | 313/25 |
| 4,891,555 | 1/1990 | Ahlgren et al. | 313/634 |

FOREIGN PATENT DOCUMENTS

2066561 A 7/1981 United Kingdom .

*Primary Examiner*—Sandra L. O'Shea
*Attorney, Agent, or Firm*—Martha Ann Finnegan

[57] ABSTRACT

An improved metal halide discharge lamp is provided. The improved metal halide includes an arc tube having a pair of electrodes and containing a fill including an inert starting gas, mercury, and metal halides; and an outer envelope enclosing the arc tube. The entire outer surface of the arc tube is coated with a heat reflective material to improve lamp efficiency.

16 Claims, 2 Drawing Sheets

METAL HALIDE LAMP HAVING REFLECTIVE COATING ON THE ARC TUBE

This is a continuation of copending application(s) Ser. No. 06/944,646 filed on Dec. 19, 1986 now abandoned.

FIELD OF THE INVENTION

The present invention relates to metal halide discharge lamps, and more particularly to metal halide lamps with arc tubes having heat reflective coatings.

BACKGROUND OF THE INVENTION

It is known to apply heat reflective coatings to arc tube ends. See, for example, U.S. Pat. Nos. 3,226,597 and 3,325,662 where it is disclosed that, in an uncoated arc tube, metal halides can condense on the envelope wall behind the electrodes and make the lamp ineffective; such condensation is prevented by reflective coatings at the ends of the arc tube. In U.S. Pat. No. 3,889,142, there is disclosed a metal halide discharge lamp having an arc tube, the ends of which have a reflective coating thereon comprising zirconium dioxide and zirconium dibromide.

In U.S. Pat. No. 3,963,951, there is disclosed an arc tube of a high intensity arc discharge lamp which is operated horizontally and has a longitudinal stripe of heat reflecting coating along the lower surface of the arc tube to improve lamp efficiency. In U.S. Pat. No. 4,249,102, there is disclosed a halogen-metal vapor discharge lamp in which the arc tube is at least partially frosted to provide a surface which has energy absorbent characteristics as well as light transmissive characteristics.

While such devices provide the intended results, there still exists a need to provide metal halide lamps having improved heat conservation together with improved lamp efficiency and a long life time.

Accordingly, an object of the present invention is to overcome the difficulties of the prior art. Another object of the invention is to provide a metal halide discharge lamp having reduced heat losses. Still another object of the invention is to provide an improved metal halide discharge lamp.

SUMMARY OF THE INVENTION

In accordance with the present invention, there is provided a metal halide discharge lamp comprising an arc tube having a pair of electrodes and containing a fill including an inert starting gas, mercury, and metal halides; and an outer envelope enclosing the arc tube. The entire outer surface of the arc tube is coated with a heat reflective material to improve lamp efficiency.

For a better understanding of the present invention, together with other and further objects, advantages and capabilities thereof, reference is made to the following disclosure and appended claims in conjunction with the accompanying drawings.

DETAILED DESCRIPTION

The present invention is directed to a metal halide discharge lamp. The metal halide discharge lamp of the present invention includes an arc tube having a pair of electrodes and containing a fill including an inert starting gas, mercury, and metal halide additives. The lamp further includes an outer envelope enclosing the arc tube. In accordance with the present invention, it has surprisingly been found that the efficiency of a metal halide discharge lamp is improved by coating the entire outer surface of the arc tube with a heat reflective material. The heat reflective material is a diffusely transmitting layer, or coating. Preferably, the thickness of the heat reflective coating is selected such that transmission of visible light through the coated arc tube is greater than or equal to about 90%.

The heat reflective coating is formed from suitable materials such as, for example, silicon oxide, zirconium oxide, aluminum oxide, and mixtures thereof. The thickness of a reflective coating of silicon oxide, zirconium oxide, aluminum oxide and mixtures thereof is most preferably greater than or equal to about 0.1 micron and less than or equal to about 10 microns. It is expected that the advantages of the present invention will be optimum for coating thicknesses of from about 0.1 to about 1 micron.

Also suitable for use as a heat reflective coating in the present invention is a dichroic multilayer coating comprising alternating layers of titanium dioxide and silicon oxide. Preferably, the first layer deposited on the arc tube surface is a silicon dioxide layer. The thickness of the individual layers of the dichroic multilayer coating is equal to "n" times one-fourth of the wavelength of the redirected infrared light component emitted from the arc discharge, wherein "n" is a positive integer greater than zero, i.e., 1,2,3, . . . The thickness of the dichroic multilayer coating is preferably from about 10 to about 20 microns and most preferably 20 microns.

Figure 1:
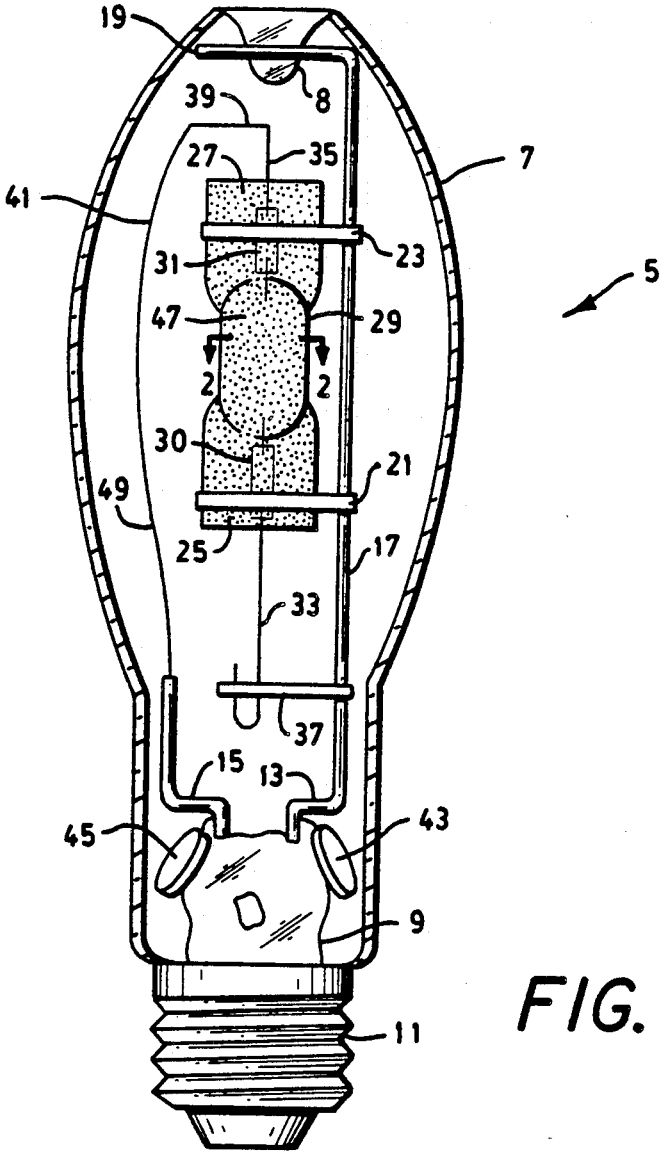
FIG. 1 is a cross-sectional view of an embodiment of a metal halide discharge lamp in accordance with the invention and shows the arc tube surface entirely coated with a heat reflective material.
Figure 2:
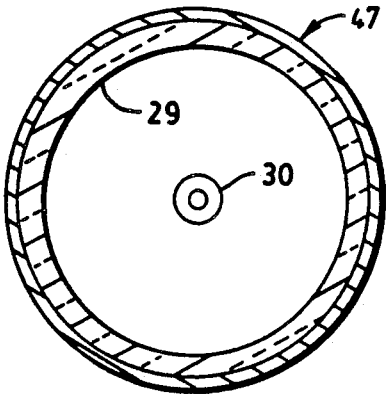
FIG. 2 is an enlarged sectional view of the arc tube taken along the lines 2—2 of FIG. 1 showing the external surface coating the heat reflective material.

Referring to FIGS. 1 and 2 of the drawings, there is shown an embodiment of the metal halide discharge lamp of the present invention. The illustrated metal halide lamp 5 is of a low wattage type. The low wattage metal halide arc discharge lamp 5 includes an evacuated outer envelope 7. This evacuated outer envelope 7 is hermetically sealed to a glass stem member 9 having an external base member 11 affixed thereto. A pair of electrical conductors 13 and 15 are sealed into and pass through the stem member 9 and provide access for energization of the discharge lamp 5 by an external source (not shown).

Within the evacuated outer envelope 7, a support member 17 is affixed to one of the electrical conductors, for example, 13 and extends substantially parallel to the longitudinal axis of the lamp 5 and forms a circular configuration 19 in conjunction with the upper portion 8 of the envelope 7 and tends to maintain the support member 17 in proper alignment and resistant to deformation caused by external shock.

A pair of strap members 21 and 23 are welded to the support member 17 and extend therefrom in a direction normal to the longitudinal axis and the direction of the support member 17 and fastened to the pressed seal ends 25 and 27 of the arc tube 29 to support the arc tube within the envelope 7. The arc tube 29 contains a fill which includes, for example, a starting gas, mercury, sodium halide, and scandium halide. Metal foil members 30 and 31 are sealed into the press seals 25 and 27 and electrical conductors 33 and 35 are attached to the foil members 30 and 31 and extend outwardly from the press seals 25 and 27. A flexible support member 37 is affixed to one of the electrical conductors 33 and to the support member 17. Also, lead 39 is affixed to the other electrical conductor 35 which connects to metal foil member 31. Moreover, a flexible spring-like member 41 connects the lead 39 to the other one 15 of the pair of electrical conductors 13 and 15. A pair of getters 43 and 45 are affixed to the electrical conductors 13 and 15 and serve to provide and maintain the vacuum within the evacuated outer envelope 7.

Deposited upon the entire outer surface of the arc tube 29 is a coating 47 of a heat reflective material. The heat reflective material is a diffusely transmitting layer, or coating, formed from suitable materials such as silicon oxide, zirconium oxide, or aluminum oxide, or a dichroic multilayer coating comprising alternating layers of titanium dioxide and silicon oxide.

The present invention is also applicable in intermediate and high wattage type metal halide lamps, the structures of which are well known in the art. One example of the various structures used in higher wattage lamps is described in U.S. Pat. No. 3,424,935 issued to W. C. Gungle on Jan. 28, 1969 which is hereby incorporated herein by reference.

The desirable color temperature for the light output of a metal halide lamp is approximately 3000° K. Low wattage metal halide lamps typically have color temperatures above 3000° K.

Advantageously, it was found that in low wattage type metal halide lamps, e.g., 100 watts or less, improved lower color temperatures are obtained when the entire arc tube is coated with a layer of silicon oxide.

In a preferred embodiment, a silicon oxide diffusely transmitting layer is applied by deposition of silica smoke in a gas burner flame. Such technique for depositing a silica smoke is well known in the art. The oxides of zirconium and aluminum can be deposited by forming a suspension in a medium such as isopropyl alcohol, coating the surface of the arc tube, removing the excess, and then firing the coating at 550° C. to 800° C. to improve adhesions.

A comparison was made between metal halide lamps prepared in accordance with the present invention, that is, coating the entire arc tube with a diffusely transmitting layer of silicon oxide by a deposition of silica smoke, and clear arc tubes having no coating.

The comparison was carried out as follows:

Four 100 watt vertical metal halide lamps designated as A, B, C and D were aged for 100 hours in base up position. Thereafter, the photometry evaluation was conducted, the results of which are shown in Table I. The average of the lumens for lamps A and B after 100 hours of operation was 9081 lumens; and the average of the color temperature for Lamps A and B after 100 hours was 3335° K. The average of the lumens for Lamps C and D after being aged for 100 hours was 9102 lumens; and the average of the color temperatures for Lamps C and D for the same period was 3201° K.

After photometry was completed, the outer jackets were removed and a heat reflective coating of silica smoke was applied to the entire surface of the arc Tubes A and B in accordance with the invention. The coating thickness was in the range of from about one (1) to about ten (10) microns. The arc tubes of lamps C and D were not coated and served as controls. The lamps were rejacketed and aged for 40 hours and photometry evaluation repeated and the results are shown in Table 2. The lumens average for Lamps A and B after being coated and aged an additional 40 hours was 8710 lumens (96%) and the average color temperature was 3092. For Lamps C and D (the uncoated control lamps), the lumens average for the same period was 8956 lumens (98%), and the average color temperature was 3322° K.

TABLE I

| Lamp | Volts | P-P Volts | Lumens | Tc °K |
|---|---|---|---|---|
| A | 102.7 | 310 | 9176 | 3394 |
| B | 96.8 | 275 | 8987 | 3276 |
| C | 96.8 | 275 | 8963 | 3067 |
| D | 99.5 | 275 | 9241 | 3335 |

TABLE 2

| Lamp | Volts | P-P Volts | Lumens | Tc °K | (after coating) ΔTc °K. |
|---|---|---|---|---|---|
| A Coated | 103.8 | 300 | 8877 | 3167 | −243° |
| B Coated | 96.9 | 28O | 8544 | 3017 | |
| C Control | 97.4 | 280 | 8946 | 3207 | +121° |
| D Control | 101.1 | 297 | 8965 | 3436 | |

The Color Temperature of Lamps A and B is dramatically improved by coating the entire outer surface of the arc tube in accordance with the present invention while only a minimum decrease in lumen efficacy is observed.

As can be seen, Lamps A and B in accordance with the invention provide improved lamps having an average decrease in color temperature relative to the control lamps of 364° Tc.

While the invention has been described with respect to preferred embodiments, it will become apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in a limiting sense.

What is claimed is:

1. A metal halide discharge lamp comprising:

an arc tube having electrodes at each end thereof and containing a fill including a starting gas, mercury and metal halides;

a heat reflective coating disposed upon the entire surface of said arc tube, said heat reflective coating having a thickness selected such that transmission of visible light through the arc tube having the heat reflective layer thereon is greater than or equal to about 90%; and an outer envelope enclosing said arc tube.

2. The metal halide discharge lamp of claim 1 wherein said heat reflective coating comprises a coating selected from the group consisting of silicon oxide, zirconium oxide, titanium oxide, aluminum oxide and mixtures thereof.

3. A metal halide discharge lamp comprising:

an arc tube having electrodes at each end thereof and containing a fill including a starting gas, mercury and metal halides;

a heat reflective coating disposed upon the entire surface of said arc tube, said heat reflective coating being a dichroic coating comprising silicon oxide and titanium oxide; and an outer envelope enclosing said arc tube.

4. The metal halide lamp of claim 3 wherein:

said dichroic coating has a total thickness of about 10 to about 20 microns;

each layer of silicon dioxide and titanium dioxide has a thickness equal to "n" times one-fourth of the wavelength of the redirected infrared light component of the arc discharge, wherein n is a positive integer greater than zero.

5. The metal halide lamps of claim 4 wherein the dichroic coating has a total thickness of about 20 microns and a silicon oxide layer is the first layer applied to the outer surface of the arc tube.

6. A low wattage metal halide discharge lamp comprising:

an arc tube having a pair of electrodes and containing a fill including starting gas, mercury and metal halides;

a heat reflective coating disposed upon the entire surface of said arc tube;

said coating being formed of silicon oxide having a thickness of from about 0.1 to about 10 microns; and an outer envelope enclosing said arc tube.

7. In a metal halide discharge lamp of the type having an arc tube having electrodes at each end thereof and containing a fill including mercury, a metal halide and a starting gas, the improvement which comprises a heat reflective coating disposed upon the entire outer surface of said arc tube, said heat reflective coating being a dichroic coating comprising alternating layer of silicon oxide and titanium oxide.

8. The metal halide discharge lamp of claim 7 wherein said heat reflective coating has a thickness of from about 1 to about 10 microns.

9. A low wattage metal halide discharge lamp comprising:

an arc tube having electrodes at each end thereof and containing a fill including a starting gas, mercury and metal halides;

a heat reflective coating disposed upon the entire surface of said arc tube, said heat reflective coating having a thickness selected such that transmission of visible light through the arc tube having the heat reflective layer thereon is greater than or equal to about 90%; and an outer envelope enclosing said arc tube.

10. The low wattage metal halide discharge lamp of claim 9 wherein said heat reflective coating comprises a coating selected from the group consisting of silicon oxide, zirconium oxide, titanium oxide, aluminum oxide, and mixtures thereof.

11. A low wattage metal halide discharge lamp comprising:

an arc tube having electrodes at each end thereof and containing a fill including a starting gas, mercury and metal halides;

a heat reflective coating disposed upon the entire surface of said arc tube, said heat reflective coating being a dichroic coating comprising silicon oxide and titanium oxide; and an outer envelope enclosing said arc tube.

12. The low wattage metal halide lamp of claim 11 wherein:

said dichroic coating has a total thickness of about 10 to about 20 microns;

each layer of silicon dioxide and titanium dioxide has a thickness equal to "n" times one-fourth of the wavelength of the redirected infrared light component of the arc discharge, wherin n is a positive interger greater than zero.

13. The low wattage metal halide lamp of claim 12 wherein the dichroic coating has a total thickness of about 20 microns; and a silicon oxide layer is the first layer applied to the outer surface of the arc tube.

14. A low wattage metal halide discharge lamp comprising:

an arc tube having a pair of electrodes and containing a fill including starting gas, mercury and metal halides;

a heat reflective coating disposed upon the entire surface of said arc tube;

said coating being formed of silicon oxide having a thickness of from about 0.1 to about 1.0 microns; and an outer envelope enclosing said arc tube.

15. In a low wattage metal halide discharge lamp of the type having an arc tube having electrodes at each end thereof and containing a fill including mercury, a metal halide and a starting gas, the improvement which comprises a heat reflective coating disposed upon the entire outer surface of said arc tube, said heat reflective coating being a dichroic coating comprising alternative layers of silicon oxide and titanim oxide.

16. The low wattage metal halide discharge lamp of claim 15 wherein said heat reflective coating has a thickness of from about 1 to about 10 micron.

* * * * *